US009774129B2

(12) United States Patent
Kikuchi

(10) Patent No.: US 9,774,129 B2
(45) Date of Patent: Sep. 26, 2017

(54) PANEL MOUNTABLE CONNECTOR WITH DETECTING PIECE THAT CAUSES GROMMET TO BULGE TO INDICATE INCOMPLETE MOUNTING ON PANEL

(71) Applicant: Sumitomo Wiring Systems, Ltd., Yokkaichi, Mie (JP)

(72) Inventor: Takahiro Kikuchi, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/308,391

(22) PCT Filed: May 7, 2015

(86) PCT No.: PCT/JP2015/063164
§ 371 (c)(1),
(2) Date: Nov. 2, 2016

(87) PCT Pub. No.: WO2015/178203
PCT Pub. Date: Nov. 26, 2015

(65) Prior Publication Data

US 2017/0062970 A1 Mar. 2, 2017

(30) Foreign Application Priority Data

May 23, 2014 (JP) ..... 2014-106867

(51) Int. Cl.
*H01R 13/73* (2006.01)
*H01R 13/52* (2006.01)
(Continued)

(52) U.S. Cl.
CPC ..... *H01R 13/5202* (2013.01); *H01R 13/641* (2013.01); *H01R 13/743* (2013.01)

(58) Field of Classification Search
USPC ..... 439/556
See application file for complete search history.

(56) References Cited

U.S. PATENT DOCUMENTS 3,941,444 A * 3/1976 Bruni ..... H01R 13/5202 439/556
4,449,778 A 5/1984 Lane
(Continued)

FOREIGN PATENT DOCUMENTS

JP 50-44493 4/1974
JP 59-171479 9/1984
(Continued)

OTHER PUBLICATIONS

International Search Report of Jul. 28, 2015.
European Search Report Dated Mar. 17, 2017.

*Primary Examiner* — Tho D Ta
(74) *Attorney, Agent, or Firm* — Gerald E. Hespos; Michael J. Porco; Matthew T. Hespos

(57) ABSTRACT

Detecting pieces (27) are provided on an outer periphery of a connector housing (10) and a resilient grommet (60) is mounted on this outer periphery. When the connector housing (10) is incompletely inserted in a mounting hole (51) of a panel (50), the detecting pieces (27) project outward by interfering with the panel (50) and the grommet (60) is pressed to bulge outward by projecting portions (31) of the detecting pieces (27). When the connector housing (10) is correctly inserted into the mounting hole (51) of the panel (50), the detecting pieces (27) are resiliently restored and release a pressed state of the grommet (60) so that a bulging state of the grommet (60) disappears.

9 Claims, 4 Drawing Sheets

(51) Int. Cl.
*H01R 13/641* (2006.01)
*H01R 13/74* (2006.01)

(56) References Cited

U.S. PATENT DOCUMENTS

| | | | | | |
|---|---|---|---|---|---|
| 4,711,507 | A | | 12/1987 | Noorily | |
| 5,044,986 | A | | 9/1991 | Baumanis | |
| 5,249,982 | A | * | 10/1993 | Funck | H01R 13/743 439/556 |
| 5,545,061 | A | * | 8/1996 | Sawayanagi | H01R 13/743 439/556 |
| 5,775,944 | A | * | 7/1998 | Flask | H01R 13/743 439/556 |
| 6,848,938 | B2 | * | 2/2005 | Miyamoto | H01R 13/743 439/556 |
| 2002/0189838 | A1 | | 12/2002 | Nakata et al. | |
| 2004/0242063 | A1 | | 12/2004 | Miyamoto | |

FOREIGN PATENT DOCUMENTS

| | | |
|---|---|---|
| JP | 2001-217033 | 8/2001 |
| JP | 2003-346990 | 12/2003 |

* cited by examiner

PANEL MOUNTABLE CONNECTOR WITH DETECTING PIECE THAT CAUSES GROMMET TO BULGE TO INDICATE INCOMPLETE MOUNTING ON PANEL

BACKGROUND

1. Field of the Invention

The present invention relates to a connector.

2. Description of the Related Art

Japanese Unexamined Patent Publication No. 2001-217033 discloses a connector to be mounted on a panel of a vehicle is disclosed in. The connector includes a male housing to be inserted into a mounting opening and mounted on the panel. A resilient male-side grommet is mounted on the male housing to cover the outer periphery of the male housing. When the male housing is inserted correctly into the mounting opening of the panel, the waterproofness of the male housing can be ensured by holding the grommet in close contact with a wall surface of the panel.

In the above case, the outer periphery of the male housing is covered with the grommet. Consequently, a state where a lock structure (locking spring) of the male housing is locked to the panel cannot be confirmed visually from a mounting side of the male housing. Thus, there is a possibility that the male housing is not correctly locked to the panel and the connector comes off from the panel.

The present invention is completed based on the above situation and aims to provide a connector enabling confirmation as to whether or not the connector is correctly mounted on a panel even if a connector housing is covered with a grommet.

SUMMARY

The present invention is directed to a connector with a connector housing to be inserted into a mounting hole of a panel. A resilient grommet is to be mounted on the connector housing to cover an outer periphery of the connector housing and is configured to be held in close contact with a wall surface of the panel when the connector housing is inserted into the mounting hole of the panel. A detecting piece is provided on the outer periphery of the connector housing. The projecting piece is configured to project outward by interfering with the panel and causes the grommet to bulge outward by pressing the grommet by a projecting part thereof when the connector housing is inserted incompletely in the mounting hole of the panel. However, the projecting piece is configured to be restored resiliently and to release a pressed state of the grommet so that a bulging state of the grommet disappears when the connector housing is inserted correctly into the mounting hole of the panel.

When the connector housing is inserted incompletely on the panel, the grommet is caused to bulge outward by the projecting part of the detecting piece. On the other hand, when the connector housing is inserted correctly on the panel, the pressed state of the grommet by the detecting piece is released and the bulging state of the grommet substantially disappears. Thus, it can be known that the connector housing is not correctly inserted on the panel, i.e. the connector housing is not correctly mounted by confirming the bulging of the grommet visually or by touch.

The detecting piece may include a lock projection configured to restrict the detachment of the connector housing from the panel in a direction opposite to an inserting direction of the connector housing by being arranged to be lockable to the panel in the direction opposite to the inserting direction when the connector housing is inserted correctly into the mounting hole of the panel. According to this configuration, the detecting piece doubles as a mounting detecting means and a locking means for the panel. Thus, the entire configuration can be simplified as compared to the case where the mounting detecting means and the locking means are separately provided.

The detecting piece may extend substantially along an inserting direction of the connector housing in a natural state and includes a support coupled to an outer surface of the connector housing at an intermediate position in an extending direction of the detecting piece. A front end part of the detecting piece in the inserting direction interferes with the panel and the detecting piece is inclined in a seesaw manner with the support as a center in the process of inserting the connector housing into the mounting hole of the panel. Thus, a rear end part of the detecting piece in the inserting direction projects out to press the grommet. According to this configuration, the mounting on the panel can be detected easily by the simply configured detecting piece.

A projecting portion of the detecting piece on a rear end in the inserting direction across the support may be longer in the inserting direction than an interfering portion located on a front end in the inserting direction across the support. Thus, when the detecting piece is inclined in a seesaw manner with the support as a center, a projecting amount of the projecting portion is large and, eventually, a bulging amount of the grommet pushed up by the projecting portion is also large. Thus, a bulging part of the grommet is confirmed with good visibility or touching and detection reliability is enhanced.

An area of the grommet to be pressed by the projecting part of the detecting piece may be formed into a thin portion thinner than a surrounding. Accordingly, even if a pressing force when the projecting part of the detecting piece presses the thin portion of the grommet is small, the grommet can be stably and reliably caused to bulge. Since interference resistance due to the interference of the detecting piece and the panel can be reduced, mounting operability to the panel is improved.

The connector housing may have a substantially rectangular cross-sectional shape and the detecting piece is provided on each of four side portions constituting the outer periphery of the connector housing. According to this configuration, an incompletely inserted state of the connector housing can be detected reliably by the detecting piece provided on at least any one of the four side portions of the connector housing.

DETAILED DESCRIPTION

Figure 1:
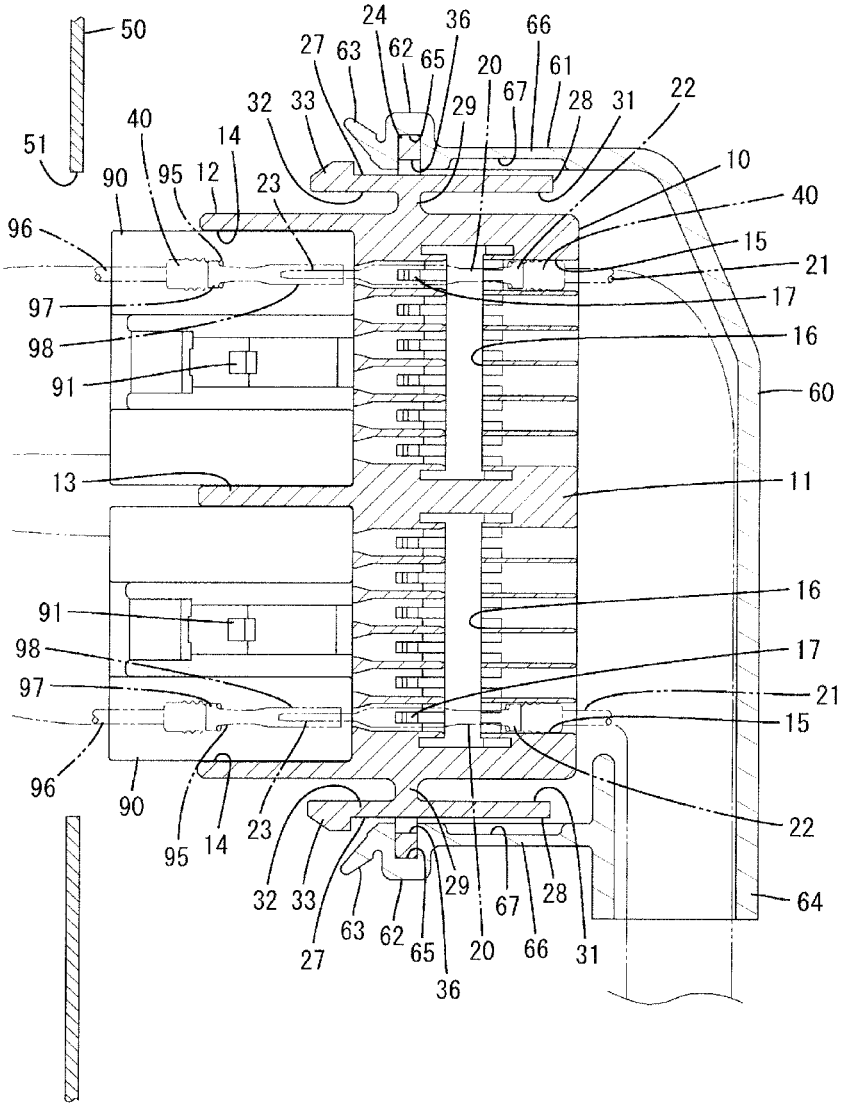
FIG. 1 is a section showing a state before a connector housing is connected to a mating connector housing and inserted into a mounting hole of a panel in an connector of an embodiment of the present invention.

An embodiment of the present invention is described with reference to FIGS. 1 to 4. A connector according to this embodiment includes a connector housing 10 and a grommet 60 to be mounted on the connector housing 10 to cover the outer periphery of the connector housing 10. The connector housing 10 is inserted into a mounting hole 51 provided on a panel 50 while being connected to mating connector housings 90, and mounted on the panel 50 via lock projections 33 to be described later. Note that, in the following description, a side on which the mating connector housings 90 are located when the connection of the two connector housings 10, 90 is started is referred to as a front end concerning a front-back direction. Further, a vertical direction is based on each figure.

Figure 4:
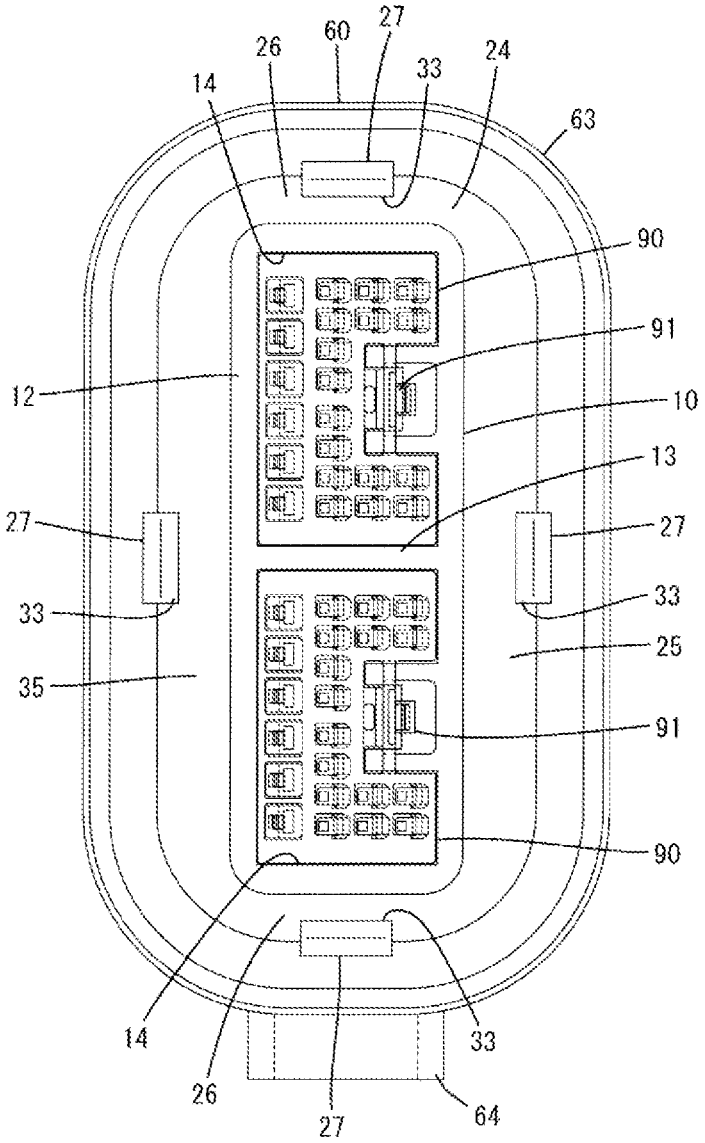
FIG. 4 is a front view showing a state where the connector housing is connected to the mating connector housing.

The connector housing 10 is made of synthetic resin and formed to have a substantially rectangular cross-section and be vertically long as a whole as shown in FIG. 4, and includes a block-like housing main body 11 and a tubular receptacle 12 projecting forward from the outer peripheral edge of the front end of the housing main body 11 as shown in FIG. 1. A partitioning portion 13 is provided to substantially horizontally extend substantially in a center of the receptacle 12 in a height direction, and the interior of the receptacle 12 is divided into a pair of upper and lower fitting portions 14 via the partitioning portion 13.

As shown in FIG. 1, the housing main body 11 is provided with a plurality of cavities 15 at positions corresponding to the respective fitting portions 14, and a retainer mounting hole 16 communicating with each cavity 15. A terminal fitting 20 is inserted into each cavity 15 from behind. The terminal fitting 20 includes a barrel 22 to be crimped and connected to a wire 21 and a rubber plug 40 and a tab 23 projecting forward. When being inserted into each cavity 15, the terminal fitting 20 is resiliently lockable by a locking lance 17 projecting in each cavity 15 so that the terminal fitting 20 is retained in the cavity 15. With the terminal fitting 20 properly inserted in each cavity 15, the tab 23 is arranged to project into the receptacle 12. Further, the terminal fitting 20 properly inserted into each cavity 15 is secondarily retained by an unillustrated retainer inserted into the retainer mounting hole 16.

The mating connector housing 90 is made of synthetic resin and, as shown in FIGS. 1 and 4, substantially in the form of a rectangular block that can fit into each fitting portion 14 of the receptacle 12. Thus, two mating connector housings 90 are connectable to the connector housing 10. A lock arm 91 is provided substantially in a vertical center of the mating connector housing 90. The lock arm 91 is resiliently locked to the fitting portion 14, whereby the mating connector housing 90 is held in the fitting portion 14.

As shown in FIG. 1, mating terminal fittings 95 are mounted in the mating connector housing 90. The mating terminal fitting 95 includes a mating barrel 97 to be crimped and connected to a wire 96 and a rubber plug 40 and a tubular box 98. When the mating connector housing 90 is properly fit into the fitting portion 14 of the receptacle 12, the tab 23 of each terminal fitting 20 is inserted and connected to the box 98 of the mating terminal fitting 95 and the terminal fittings 20, 95 are connected electrically.

As shown in FIG. 4, the connector housing 10 is provided with a flange 24 bulging out over the entire circumference on the outer peripheral surface of the housing main body 11. Detecting pieces 27 are provided at a plurality of circumferentially spaced-apart positions of the flange 24, specifically substantially in centers of left and right long sides 25 in a height direction and substantially in widthwise centers of a pair of upper and lower short sides 26. That is, the detecting piece 27 is provided on each of four sides constituting the outer periphery of the connector housing 10. As shown in FIG. 1, the detecting piece 27 is composed of a detection arm 28 in the form of a plate projecting both forward and backward at a position substantially in a center in a bulging direction of the flange 24 and a support 29 constituting a base end part in the bulging direction of the flange 24 and extending from the outer peripheral surface of the housing main body 11 to the detection arm 28. The detection arm 28 is arranged along the front-back direction in a natural state. A part of the detection arm 28 projecting back from the rear surface of the flange 24 (hereinafter, referred to as a projecting portion 31) is longer in the front-back direction than a part projecting forward from the front surface of the flange 24 (hereinafter, referred to as an interfering portion 32). In this way, the detection arm 28 includes the interfering portion 32 on a front side and the projecting portion 31 extending longer than the interfering portion 32 on a rear side out of both front and rear sides of the support 29.

As shown in FIG. 1, the claw-like lock projection 33 projecting outward is provided on a front end part of the interfering portion 32 of the detection arm 28. The front surface of the lock projection 33 is inclined out to have a tapered shape, and the rear surface of the lock projection 33 extends along the height direction. At backward projection positions of the lock projections 33, the flange 24 is provided with through holes 36 formed as a mold for molding the lock projections 33 passes. On the other hand, the projecting portion 31 of the detection arm 28 is in the form of an even and flat strip plate as a whole.

The grommet 60 is made of rubber and, as shown in FIG. 1, formed into a boot shape to be mounted on the connector housing 10 to surround the entire housing main body 11. Each wire 21 pulled out from the rear surface of the connector housing 10 is accommodated in the grommet 60. Specifically, the grommet 60 is composed of a tubular surrounding portion 61 extending along the front-back direction, a mounting portion 62 in the form of an annular projection connected to the front end of the surrounding portion 61 and projecting out, a seal 63 conically widened forward from the front end of the mounting portion 62 and a tubular wire draw-out portion 64 connected to the rear end of the surrounding portion 61, vertically extending and projecting farther down than the surrounding portion 61. Each wire 21 pulled out from the rear surface of the connector housing 10 is bent by an inner wall of the wire draw-out portion 64 and drawn out downward through a lower end opening of the wire draw-out portion 64.

Figure 3:
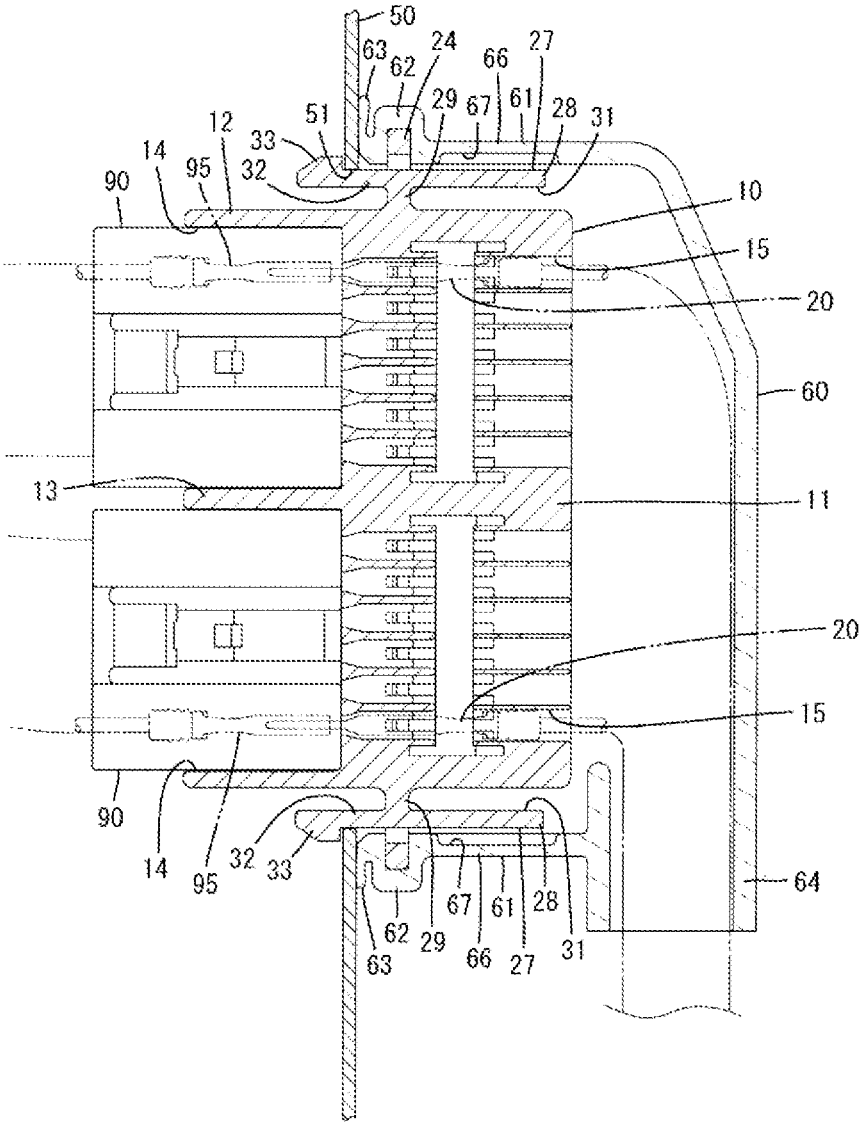
FIG. 3 is a section showing a state where the connector housing is correctly inserted in the mounting hole of the panel.

As shown in FIG. 1, the mounting portion 62 has a substantially U-shaped cross-section and a fitting groove 65 is provided over the entire circumference on the inner peripheral surface. By fitting a tip part of the flange 24 into the fitting groove 65 of the mounting portion 62, the grommet 60 is positioned and mounted on the connector housing 10. As shown in FIG. 3, the seal 63 is held resiliently in close contact with an opening edge part of the mounting hole 51 on the rear surface of the panel 50 over the entire circumference when the connector housing 10 is mounted on the panel 50. The intrusion of water into the mounting hole 51 is prevented by holding the seal 63 in close contact with the rear surface of the panel 50.

Figure 2:
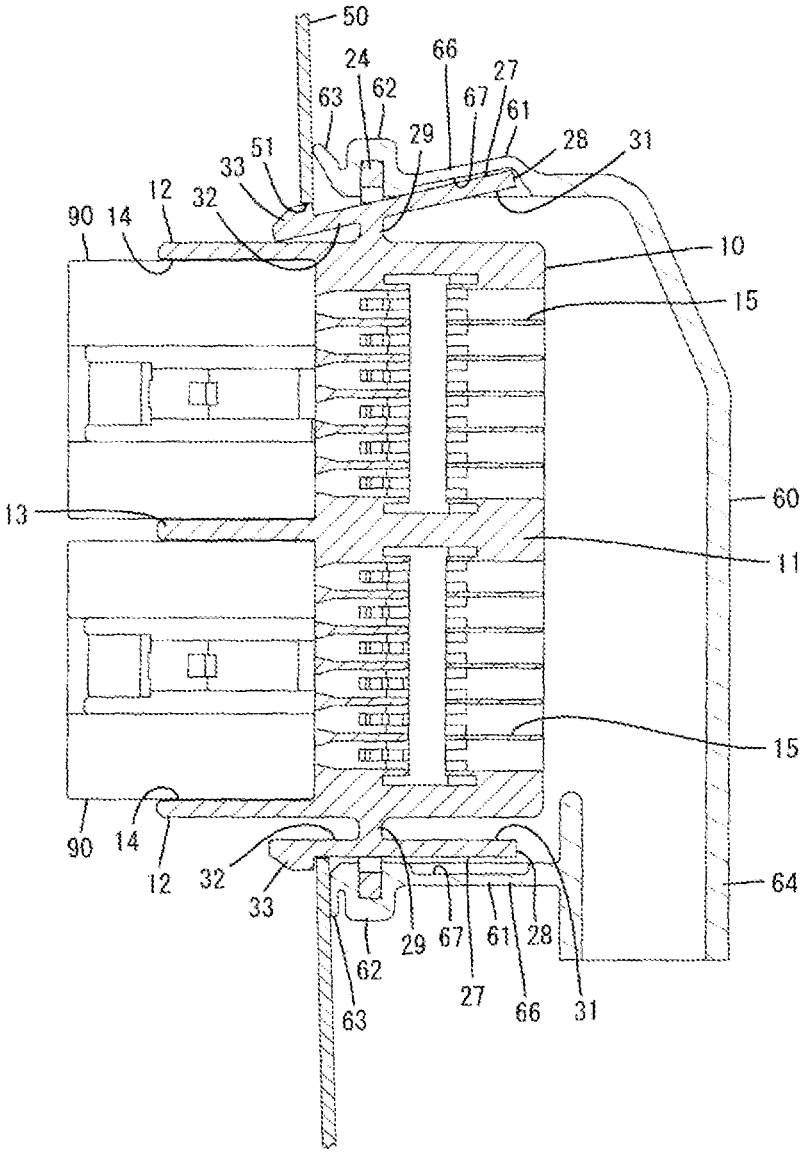
FIG. 2 is a section showing a state where the connector housing is incompletely inserted in the mounting hole of the panel.

Further, as shown in FIG. 2, the surrounding portion 61 is provided with thin portions 66 thinner than the surroundings in parts that can be pressed by being brought into contact with the projecting portions 31 of the respective detecting pieces 27 as described later. The thin portions 66 are thinned by recesses 67 provided on the inner peripheral surface of the surrounding portion 61 and have substantially half the thickness of parts of the surrounding portion 61 other than the thin portions 66. Note that the outer peripheral surface of the surrounding portion 61 is substantially entirely even As shown in FIG. 1, the mating connector housings 90 are fit into the fitting portions 14 of the receptacle 12 and the connector housings 10, 90 are held in a connected state before the connector is mounted on the panel 50. Further, the grommet 60 is mounted on the housing main body 11 of the connector housing 10.

Subsequently, the connector housing 10 in the connected state (hereinafter, merely referred to as the connector housing 10 unless particularly necessary) is inserted into the mounting hole 51 of the panel 50.

In the process of inserting the connector housing 10 into the mounting hole 51 of the panel 50, the lock projection 33 of each detecting piece 27 interferes with the opening edge part of the mounting hole 51 of the panel 50 and the detection arm 28 of each detecting piece 27 is inclined in a seesaw manner (see upper detecting piece 27 shown in FIG. 2) with the support 29 as a supporting point so that the interfering portion 32 moves toward the housing main body 11 and the projecting portion 31 moves away from the housing main body 11. As the detection arm 28 of each detecting piece 27 is inclined, the projecting portion 31 is fitted into the recess 67 of each thin portion 66 of the grommet 60 and each thin portion 66 is pressed by the projecting portion 31 to resiliently bulge outward.

As shown in FIG. 3, when the connector housing 10 is inserted correctly into the mounting hole 51 of the panel 50, the lock projection 33 of each detecting piece 27 passes the mounting hole 51 of the panel 50 and the detection arm 28 is resiliently restored to an initial horizontal posture. Then, the projecting portion 31 also returns to a horizontal posture and comes out of the recess 67, thereby releasing the thin portion 66 of the grommet 60 from the pressed state. In this way, the thin portion 66 is restored resiliently, the bulging state substantially disappears and the outer surface of the surrounding portion 61 is restored to an initial flat surface.

Further, as shown in FIG. 3, when the connector housing 10 is correctly inserted into the mounting hole 51 of the panel 50, the rear surface of the lock projection 33 of each detecting piece 27 faces the opening edge part of the mounting hole 51 on the front surface of the panel 50 and the lock projection 33 of each detecting piece 27 is arranged to be lockable to the panel 50. Thus, even if a backward (direction opposite to an inserting direction into the mounting hole 51) pull-out force acts on the connector housing 10, the lock projection 33 of each detecting piece 27 is locked to the panel 50 and the connector housing 10 is prevented from coming off from the panel 50. Further, the flange 24 faces the opening edge part of the mounting hole 51 on the rear surface of the panel 50 via the seal 63 of the grommet 60, thereby preventing the connector housing 10 from being inserted any deeper into the mounting hole 51 of the panel 50.

On the other hand, if the connector housing 10 is left incompletely inserted in the mounting hole 51 of the panel 50, e.g. if the connector housing 10 is obliquely inserted into the mounting hole 51 of the panel 50 to hold any one of the four side portions away from the panel 50, some of the detecting pieces 27 still are inclined and the lock projections 33 are located in the mounting hole 51 as shown in FIG. 2. Thus, the projecting portions 31 of the detecting pieces 27 press the thin portions 66 of the grommet 60 as in the inserting process described above and a state where the thin portions 66 of the grommet 60 are bulging is maintained. Thus, it can be known that the connector housing 10 is in an incompletely inserted state by visually confirming the pressed state of the thin portions 66 of the grommet 60 from the rear side (right side of FIG. 2) of the panel 50 or confirming such a state by touching with the hand. Particularly, in the case of this embodiment, since only the thin portions 66 of the surrounding portion 61 of the grommet 60 bulge outward when the connector housing 10 is incompletely inserted, good visibility or touching is ensured.

As described above, according to this embodiment, the grommet 60 is caused to bulge out by the projecting portions 31 of the detecting pieces 27 when the connector housing 10 is inserted insufficiently on the panel 50 as shown in FIG. 2. On the other hand, when the connector housing 10 is inserted properly on the panel 50 as shown in FIG. 3, the pressed state of the grommet 60 by the detecting pieces 27 is released and the bulging state of the grommet 60 substantially disappears. Thus, by confirming the bulging of the grommet 60 visually or by touch, it can be known that the connector housing 20 is not inserted correctly on the panel 50, i.e. the connector is not correctly mounted on the panel 50.

Further, since the lock projections 33 of the detecting pieces 27 have a locking function of retaining the connector housing 10 on the panel 50, a mounting detecting means and a locking means for the panel 50 are integrated on the detecting pieces 27, whereby the entire configuration is simplified.

Furthermore, since the thin portions 66 of the grommet 60 are caused to bulge by the seesaw-like inclination of the detecting pieces 27 with the supports 29 as supporting points, the mounting on the panel 50 can be detecterd easily by the detecting pieces 27 that have a relatively simple structure.

Further, since the areas of the grommet 60 to be pressed by the projecting portions 31 of the respective detecting pieces 27 are formed into the thin portions 66 thinner than the surroundings, the grommet 60 stably and reliably can be caused to bulge even if pressing forces when the projecting portions 31 of the respective detecting pieces 27 press the thin portions 66 of the grommet 60 are small in the process of inserting the connector housing 10 into the mounting hole 51. As a result, interference resistance due to the interference of the detecting pieces 27 and the panel 50 can be reduced and mounting operability to the panel 50 is improved.

The invention is not limited to the above described and illustrated embodiment. For example, the following modes also are included in the technical scope of the present invention.

The detecting pieces may be pieces dedicated to detect mounting without having the locking function to the panel.

The detecting pieces and the connector housing may be separately formed.

Only one detecting piece may be formed on the outer periphery of the connector housing.

The detecting pieces may be provided at positions different from the flange portion. For example, the detecting pieces may project from the outer surface of the receptacle.

The connector housing may be a waiting-side connector housing to be mounted on a panel before being connected to a mating connector housing.

LIST OF REFERENCE SIGNS

10 . . . connector housing
11 . . . housing main body
12 . . . receptacle
27 . . . detecting piece

28 . . . detection arm
31 . . . projecting portion
32 . . . interfering portion
33 . . . lock projection
50 . . . panel
51 . . . mounting hole
60 . . . grommet
66 . . . thin portion
90 . . . mating connector housing

The invention claimed is:

1. A connector, comprising:

a connector housing having a front end to be inserted into a mounting hole of a panel and a rear end opposite the front end;

a resilient grommet to be mounted on the connector housing to cover an outer periphery of areas of the connector housing extending forward from the rear end and configured to be held in close contact with a wall surface of the panel when the front end of the connector housing is inserted into the mounting hole of the panel; and a detecting piece having a support projecting out on the outer periphery of the connector housing, an interfering portion projecting forward from the support and configured to interfere with the panel when inserting the front end of the housing into the mount hole and to deflect inward and the interfering portion returning to an undeflected position when the connector housing is mounted correctly on the panel, and a projecting portion projecting rearward from the support and deflecting out when the interfering portion deflects in, so that a rear projecting part of the interfering portion causes the grommet to bulge outward by pressing the grommet when the connector housing is incompletely inserted in the mounting hole of the panel while being configured to resiliently restored and release a pressed state of the grommet so that a bulging state of the grommet disappears when the connector housing is correctly inserted into the mounting hole of the panel.

2. The connector of claim 1, wherein the interfering portion of the detecting piece includes a lock projection configured to restrict detachment of the connector housing from the panel in a direction opposite to an inserting direction of the connector housing by being locked to the panel in the direction opposite to the inserting direction when the connector housing is correctly inserted into the mounting hole of the panel.

3. The connector of claim 2, wherein a length of projecting portion of the detecting piece rearward from the support exceeds a length of the interfering portion forward from the support.

4. The connector of claim 3, wherein an area of the grommet to be pressed by the projecting portion of the detecting piece is formed into a thin portion that is thinner than surrounding areas of the grommet that are not pressed by projecting portion of the detecting piece.

5. The connector of claim 4, wherein the connector housing has a substantially rectangular cross-sectional shape and the detecting piece is provided on each of four side portions constituting the outer periphery of the connector housing.

6. A connector comprising:

a connector housing to be inserted into a mounting hole of a panel;

a resilient grommet to be mounted on the connector housing to cover an outer periphery of the connector housing and configured to be held in close contact with a wall surface of the panel when the connector housing is inserted into the mounting hole of the panel; and a detecting piece provided on the outer periphery of the connector housing and configured to project outward by interfering with the panel and cause the grommet to bulge outward by pressing the grommet by a projecting part thereof when the connector housing is incompletely inserted in the mounting hole of the panel while being configured to be resiliently restored and release a pressed state of the grommet so that a bulging state of the grommet disappears when the connector housing is correctly inserted into the mounting hole of the panel, wherein the detecting piece extends substantially along an inserting direction of the connector housing in a natural state and includes a support coupled to an outer surface of the connector housing at an intermediate position in an extending direction of the detecting piece, and a front end part of the detecting piece in the inserting direction interferes with the panel and the detecting piece is inclined in a seesaw manner with the support as a center in the process of inserting the connector housing into the mounting hole of the panel, whereby a rear end part of the detecting piece in the inserting direction projects outward to press the grommet.

7. The connector of claim 6, wherein a projecting length of the detecting piece rearward of the support and parallel to the inserting direction is longer than a projecting length of an interfering portion forward of the support and parallel to the inserting direction.

8. The connector of claim 6, wherein an area of the grommet to be pressed by the rear end part of the detecting piece is formed into a thin portion that is thinner than areas of the grommet that are not pressed by the rear end part of the detecting piece.

9. The connector of claim 6, wherein the connector housing has a substantially rectangular cross-sectional shape and the detecting piece is provided on each of four side portions constituting the outer periphery of the connector housing.

* * * * *